US010488134B2

(12) United States Patent
Olson et al.

(10) Patent No.: US 10,488,134 B2
(45) Date of Patent: Nov. 26, 2019

(54) TWO-STAGE, DROP-IN TRIGGER ASSEMBLY

(71) Applicant: KRL Holding Company, Inc., Milan, IL (US)

(72) Inventors: Douglas Dean Olson, Huntsville, AR (US); Joe Beitelspacher, Davenport, IA (US)

(73) Assignee: KRL Holding Company, Inc., Eldridge, IA (US)

( * ) Notice: Subject to any disclaimer, the term of this patent is extended or adjusted under 35 U.S.C. 154(b) by 0 days.

(21) Appl. No.: 16/280,574

(22) Filed: Feb. 20, 2019

(65) Prior Publication Data

US 2019/0257606 A1 Aug. 22, 2019

Related U.S. Application Data

(60) Provisional application No. 62/632,590, filed on Feb. 20, 2018.

(51) Int. Cl.
*F41A 19/10* (2006.01)
*F41A 17/46* (2006.01)

(52) U.S. Cl.
CPC ..... *F41A 19/10* (2013.01); *F41A 17/46* (2013.01)

(58) Field of Classification Search
CPC ..... F41A 19/10; F41A 17/46
USPC ..... 42/69.01
See application file for complete search history.

(56) References Cited

U.S. PATENT DOCUMENTS

| | | | |
|---|---|---|---|
| 2,090,656 | A | 8/1937 | Williams |
| 2,361,519 | A | 10/1944 | Williams |
| 2,366,823 | A | 1/1945 | Williams |
| 2,373,213 | A | 4/1945 | Williams |
| 2,383,487 | A | 8/1945 | Johnson, Jr. |

(Continued)

FOREIGN PATENT DOCUMENTS

| | | | |
|---|---|---|---|
| BE | 687221 | A | 3/1967 |
| DE | 20201104556 | U1 | 8/2012 |

(Continued)

OTHER PUBLICATIONS

English translation of DE102014107620B3 by Lexis Nexis Total Patent on Oct. 9, 2015 (pp. 27).

(Continued)

*Primary Examiner* — Michelle Clement
(74) *Attorney, Agent, or Firm* — Woodard, Emhardt, Henry, Reeves & Wagner, LLP

(57) ABSTRACT

A trigger assembly for a firearm is disclosed wherein the firearm includes a receiver, a safety selector and a hammer. The trigger assembly includes a trigger having a pivot axis, a front hook which is constructed and arranged to move with trigger rotation, a rear hook which is cooperatively arranged with the front hook and a spring which is positioned between the front hook and the rear hook. The front hook and the trigger are constructed and arranged relative to the safety selector and relative to the hammer in order to allow the hammer to be recocked from an upright position with the safety selector in a "SAFE" position. This particular construction provides a trigger assembly which is constructed and arranged as a two-stage, drop-in trigger assembly which is compliant with the European Standard for an M4/M16 (AR) platform.

10 Claims, 15 Drawing Sheets

(56) References Cited

U.S. PATENT DOCUMENTS

| | | | | |
|---|---|---|---|---|
| 2,461,670 | A | 2/1949 | Williams | |
| 3,292,492 | A | 12/1966 | Sturtevant | |
| 4,004,496 | A | 1/1977 | Snodgrass | |
| 4,693,169 | A | 9/1987 | Beretta | |
| 5,012,604 | A | 5/1991 | Rogers | |
| 5,274,939 | A | 1/1994 | Scaramucci | |
| 5,501,134 | A * | 3/1996 | Milazzo | F41A 19/16 42/69.03 |
| 6,131,324 | A | 10/2000 | Jewell | |
| 6,615,527 | B1 | 9/2003 | Martin | |
| 6,772,548 | B1 * | 8/2004 | Power | F41A 19/10 42/69.03 |
| 6,966,138 | B1 * | 11/2005 | Deckard | F41A 19/24 42/69.01 |
| 7,293,385 | B2 | 11/2007 | McCormick | |
| 7,331,136 | B2 | 2/2008 | Geissele | |
| 7,421,937 | B1 * | 9/2008 | Gangl | F41A 17/46 42/69.03 |
| 7,600,338 | B2 * | 10/2009 | Geissele | F41A 19/10 42/69.03 |
| 7,854,084 | B1 * | 12/2010 | Rutherford | F41A 19/43 42/69.01 |
| 7,878,106 | B2 * | 2/2011 | Hu | F41A 19/02 89/129.02 |
| 7,992,335 | B2 * | 8/2011 | Gangl | F41A 17/46 42/69.03 |
| 8,220,192 | B2 | 7/2012 | Fluhr | |
| 8,756,847 | B2 | 6/2014 | Huther | |
| 8,820,211 | B1 | 9/2014 | Hawbaker | |
| 8,826,789 | B2 | 9/2014 | Bagley | |
| 8,893,607 | B2 | 11/2014 | Audibert | |
| 8,985,006 | B1 | 3/2015 | Christensen | |
| 9,267,751 | B2 * | 2/2016 | Ruiz | F41A 19/12 |
| 9,310,150 | B1 * | 4/2016 | Geissele | F41A 19/16 |
| 9,618,289 | B1 * | 4/2017 | Geissele | F41A 19/46 |
| 9,638,485 | B2 * | 5/2017 | Geissele | F41A 19/10 |
| 9,835,398 | B2 * | 12/2017 | Biegel | F41A 19/15 |
| 9,869,522 | B2 * | 1/2018 | Larson, Jr. | F41A 19/16 |
| 9,927,197 | B1 * | 3/2018 | Geissele | F41A 19/10 |
| 10,156,410 | B1 * | 12/2018 | McKillips | F41A 19/10 |
| 10,393,460 | B2 * | 8/2019 | Geissele | B23H 7/02 |
| 10,393,461 | B2 * | 8/2019 | Fellows | F41A 19/14 |
| 2005/0241470 | A1 | 11/2005 | Hochstrate | |
| 2006/0086031 | A1 * | 4/2006 | Geissele | F41A 19/16 42/69.03 |
| 2007/0180984 | A1 | 8/2007 | Huther | |
| 2009/0183414 | A1 * | 7/2009 | Geissele | F41A 19/10 42/69.03 |
| 2010/0281739 | A1 * | 11/2010 | Geissele | F41A 19/16 42/69.01 |
| 2015/0153125 | A1 * | 6/2015 | Lutton | F41A 17/46 42/69.01 |
| 2015/0233662 | A1 * | 8/2015 | Ruiz | F41A 19/10 42/69.03 |
| 2015/0253095 | A1 * | 9/2015 | Wilson | F41A 19/10 42/69.01 |
| 2016/0018176 | A1 * | 1/2016 | Fellows | F41A 19/02 42/69.03 |
| 2016/0131449 | A1 * | 5/2016 | Horch | F41A 19/16 42/69.01 |
| 2016/0161202 | A1 * | 6/2016 | Larue | F41A 19/45 42/69.01 |
| 2016/0178304 | A1 * | 6/2016 | Geissele | F41A 19/10 42/69.01 |
| 2017/0089655 | A1 * | 3/2017 | Geissele | F41A 19/46 |
| 2017/0138689 | A1 * | 5/2017 | Biegel | F41A 19/15 |
| 2017/0299306 | A1 * | 10/2017 | Larson, Jr. | F41A 19/16 |
| 2017/0299309 | A1 * | 10/2017 | Fellows | F41A 17/46 |
| 2017/0328663 | A1 * | 11/2017 | Fellows | F41A 19/14 |

FOREIGN PATENT DOCUMENTS

| | | | |
|---|---|---|---|
| DE | 102014107620 | B3 | 2/2015 |
| FR | 1530296 | A | 6/1968 |
| WO | WO 03/076863 | A1 | 9/2003 |

OTHER PUBLICATIONS

English translation of DE202011004556U1 by Lexis Nexis Total Patent on Oct. 9, 2015 (pp. 17).

Heckler& Koch, "MR556A1 Operator's Manual," Columbus, Georgia, Apr. 4, 2011.

Knights Armament Company, "Knight's Manufacturing Description of the 2-stage trigger," http://quarterbore.com/kac/kac2stage.html, dated Mar. 26, 2004 (downloaded Jan. 22, 2019).

Machine translation of BE687221A by PatBase on Mar. 25, 2019 (pgs. 21).

Machine translation of FR1530296A by PatBase on Mar. 25, 2019 (pgs. 14).

Screenshort from Knights Armament Company website showing the Knight's Armament AR-15 Drop-In 2-Stage Match Trigger Kit, Semi-Auto 25926 on Sep. 26, 2019.

Screenshort from Knights Armament Company website showing the Knight's Armament SR-15 IWS Lower Receiver Assembly on Sep. 26, 2019.

* cited by examiner

TWO-STAGE, DROP-IN TRIGGER ASSEMBLY

CROSS-REFERENCE TO RELATED APPLICATIONS

This application claims the benefit of U.S. Provisional Application No. 62/632,590 filed Feb. 20, 2018, which is hereby incorporated by reference.

BACKGROUND

The present disclosure pertains generally to firearms. In particular the present disclosure describes and explains the construction and use of a two-stage, drop-in trigger assembly, for M4/M16 (AR) firearms, which is compliant with what is described herein as the "European Standard".

The "European Standard", as used herein, requires that the safety selector must allow selection to the "SAFE" position when the hammer is in the upright or "as fired" condition. This upright condition of the hammer is also described herein as being an up/forward position. Once in this position it is desired that the bolt carrier be allowed to fully retract thereby cocking the hammer, without damaging any components of the trigger assembly. The European Standard requires a trigger assembly construction which is different from those constructions normally built for US produced M4/M16 (AR) firearms.

One prior art construction for a trigger assembly required the hammer to keep the trigger depressed when the hammer is in the upright position. This construction effectively prevents the safety selector from being turned to the "SAFE" position. This prior art construction is common for US produced M4/M16 (AR) platform rifles. Newer prior art trigger assembly constructions allow the safety to be set to "SAFE" with the hammer in the upright position. However, importantly these trigger assembly constructions are of the single stage, non-adjustable style.

In order to be compliant with the European Standard for a two-stage trigger assembly for the AR platform, the safety selector must be able to be placed into the "SAFE" position when the hammer is forward in the upright (fired) position. The present disclosure is directed to a novel and unobvious two-stage, drop-in trigger assembly which conforms to and is compliant with the European Standard. As used herein, the referenced drop-in style of trigger assembly is also described as a non-adjustable style of trigger assembly.

As further background for the present disclosure, the field of the present disclosure encompasses trigger assemblies for AR platform rifles. There are two basic classes of construction which include single-stage and two-stage. Each of these classes of construction is further divided into adjustable and non-adjustable subclasses.

A single-stage trigger assembly includes a sear notch which is below the hammer pivot axis. The radius to the release point of the hammer is typically approximately 0.30 inches (7.62 mm) from the hammer pivot axis. The hammer spring applies a torque to the hammer which develops a force at this radius which is relatively high. Accordingly, the single-stage trigger assembly is noted for having a long pull requiring considerable pressure on the trigger in order to fire the weapon. This trigger pull is usually notable for several starts and stops as the trigger pulls through this arc and this is commonly referred to as "creep".

There is a subclass of single-stage trigger assemblies known as adjustable single-stage trigger assemblies which provides a method of reducing the amount of sear engagement by means of a block of some kind that can be adjusted by the user of the firearm (i.e. shooter) or a gunsmith. This provides a shorter trigger pull but typically without reducing the amount of trigger pressure required to fire the firearm. The hammer has a cam which keeps the trigger rotated when the hammer is in the upright or fired position. This effectively prohibits the rotation of the safety selector to the "SAFE" position.

A two-stage trigger assembly includes a construction where the sear surface on the hammer is relocated to an overhanging appendage which is typically at a radius of approximately 0.77 inches (1.96 cm) from the hammer pivot axis. Assuming use of the same hammer spring in the two-stage construction as used in the single-stage construction, there is a lower spring force which is developed. More specifically, the force developed at the sear surface is 0.3/0.77 or approximately 39% of the force of a typical single-stage trigger assembly.

A lower force at the sear surface reduces the amount or level of friction required to separate the hammer sear surface from the trigger sear surface thus requiring less trigger pressure to fire the weapon. The disconnector (also known as the rear hook) for a two-stage trigger assembly is given a second task. This rear hook is brought to bear against the backside of the hammer's overhanging appendage just prior to the hammer's release. This is felt as a second stage to the trigger pull which somewhat increases the amount of trigger pressure required to be applied to the trigger in order to release the hammer.

Because there is very little movement of the trigger required to accomplish this movement, the user of the firearm (i.e. the shooter) can simply pull the trigger to the second stage then hold it there until the shooter is ready to fire the weapon, thereby allowing for more accurate site position at the instant of firing. There is a subclass that is an adjustable two-stage trigger assembly wherein the shooter or his gunsmith can adjust a specific set of parts to have an even more precise amount of second-stage engagement.

It would be an improvement to the current state-of-the-art of two-stage, drop-in trigger assemblies if these constructions could be made compliant with the European Standard. This compliance requires that the construction enable the safety selector to be placed in the "SAFE" position when the hammer is forward in the upright (fired) position.

SUMMARY

The present disclosure pertains generally to trigger assemblies for M4/M16 (AR) platform firearms. More particularly the present disclosure pertains generally to two-stage, drop-in trigger assemblies which are compliant with the European Standard. As described herein, the European Standard requires that the safety selector is able to be placed in the "SAFE" position when the hammer is in the upright or "as fired" condition.

A starting point for the conception and design work which resulted in the construction of the present disclosure was to consider the design and components of earlier constructions related to a military "BURST" trigger assembly. As part of this earlier design work it was learned that removal of the "BURST" actuator provided a place or location in which to mount a front hook for interfacing with a new hammer. The new hammer construction included an overhanging appendage with a new sear surface. The front hook was offset from the center of the trigger and required an overhanging portion for a sufficient sear engagement surface.

Following this earlier design work it was envisioned that the design of the front hook could be changed so as to allow it to rotate just enough to allow the hammer to move the front hook of the trigger assembly out of the way. This in turn would then allow recocking of the hammer when the trigger's rotation was impaired by having the safety selector being placed in the "SAFE" condition.

As a further aspect of the present disclosure, the trigger assembly is constructed and arranged so as to not require the trigger to be depressed when the hammer is in the upright position. As a result, the disclosed construction allows the safety selector to be engaged and for the hammer to be recocked with the safety selector in the "SAFE" position. This construction is thereby compliant with the European Standard.

In order to provide a preferred drop-in or non-adjustable trigger assembly construction, it was desired to design the parts such that they were relatively insensitive to manufacturing tolerances. This was accomplished by having the surface on the front hook which contacts the trigger and thus controls the relative position of the front hook to the trigger to be at a considerable distance from the front hook pivot axis compared to prior art structures. In the design which is represented by the present disclosure this distance was set at approximately 1.16 inches (2.95 cm). The radius from the front hook pivot axis to the actual sear surface is approximately 0.38 inches (9.65 mm). Accordingly a manufacturing tolerance of +/−0.006 inches (0.152 mm) at the contact point only moves the sear surface approximately +/−0.002 inches (0.051 mm). Maintaining the front hook position relative to the trigger enables standard manufacturing tolerances with minimal change to the hook position relative to other fire control components.

A further aspect of the disclosed trigger assembly is the relocation of the front hook spring to a position ahead of the trigger pivot axis. A related construction aspect is to allow the front hook to pivot up to 8.5 degrees but only when the hammer must move by the front hook when the trigger is prevented from rotating by the safety selector. At all other times the front hook remains stationary to the trigger. A standard disconnector spring is used under the front hook to allow sufficient force to be applied to the front hook in order to prevent it from moving under severe shock loadings (normally associated with drop-testing of the firearm).

By constructing and arranging the front hook for pivoting about the trigger pivot axis, the center of mass of the front hook is kept close to its center rotation thereby preventing shock loadings from developing a level of force which could lead to the front hook losing contact with the sear surface of the hammer under these shock loadings. The disclosed construction is relatively insensitive to manufacturing tolerances by having long parts instead of short parts. Having the front hook bridge the disconnector (rear hook) also enhances the stability of the front hook during trigger pull.

In many triggers, if the operator holds the trigger in a depressed position through the reload cycle, the operator can experience a forward counter force applied to the pull surface of the trigger due to the hammer impacting the rear hook, which often would compress the spring between the trigger and the rear hook to the spring's stack height causing some portion of the impact to be transmitted through the trigger to the operator's finger depressing the trigger. This has been referred to as "trigger slap." Conversely, holding the trigger of the disclosed trigger and hammer group in the depressed position during the reload cycle resulted in a significant reduction and even elimination of felt trigger slap.

DESCRIPTION OF THE SELECTED EMBODIMENTS

Figure 1:
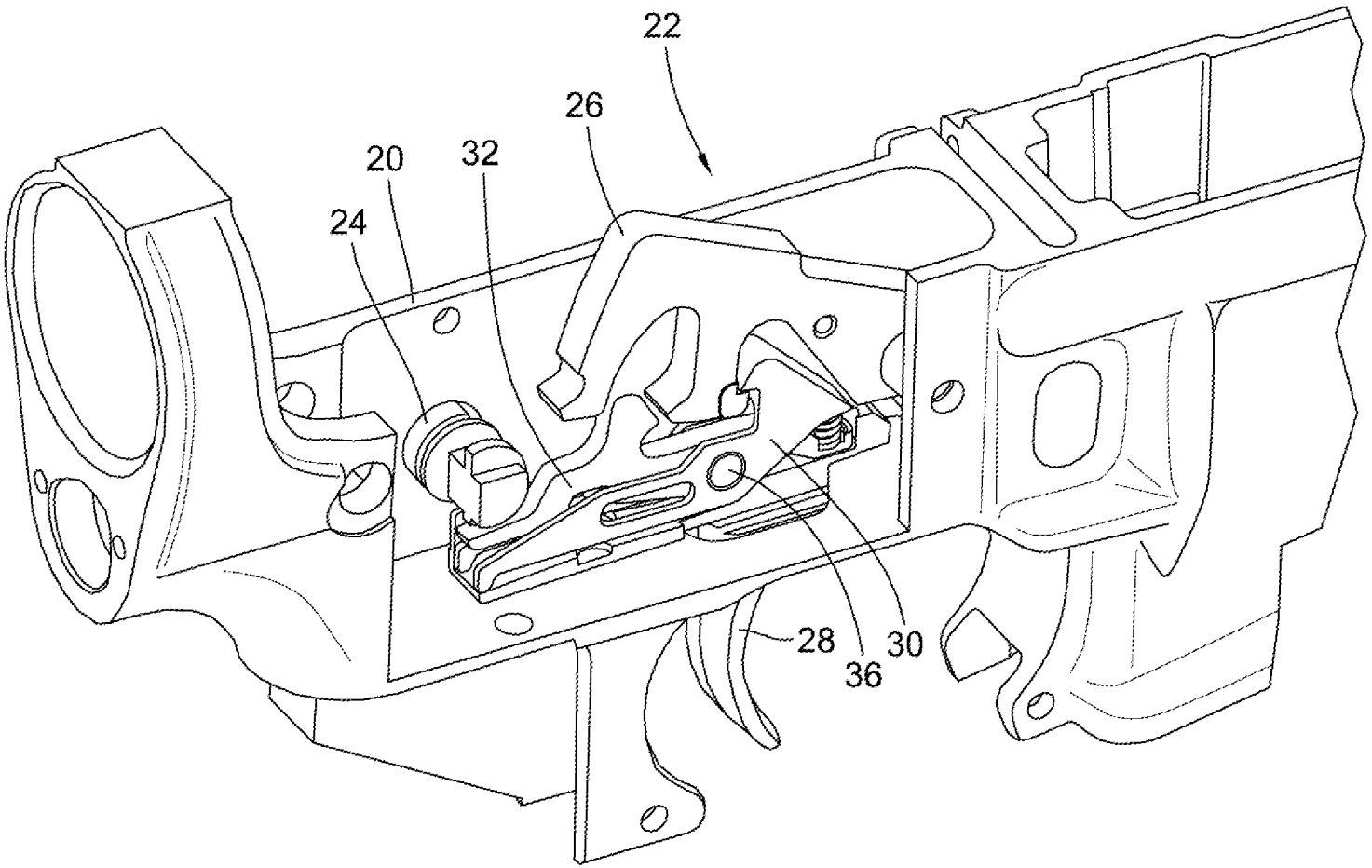
FIG. 1 is a partial perspective view of a firearm receiver including a trigger assembly according to an exemplary embodiment.

For the purpose of promoting an understanding of the principles of the claimed invention, reference will now be made to the embodiments illustrated in the drawings and specific language will be used to describe the same. It will nevertheless be understood that no limitation of the scope of the claimed invention is thereby intended. Any alterations and further modifications in the described embodiments, and any further applications of the principles of the claimed invention as described herein are contemplated as would normally occur to one skilled in the art to which the claimed invention relates. One embodiment of the claimed invention is shown in great detail, although it will be apparent to those skilled in the relevant art that some features that are not relevant to the present claimed invention may not be shown for the sake of clarity.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "left", "right", "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Referring to FIG. 1 a partial perspective view of a firearm receiver 20 is illustrated. Receiver 20 includes (i.e. receives) a trigger assembly 22 which represents an exemplary embodiment. The trigger assembly 22 may include individual features and concepts which are adaptable to various firearm platforms. However, for the present disclosure the focus is on the entire trigger assembly 22 and its use on an M4/M16 (AR) platform. The trigger assembly 22 is constructed and arranged for use as a two-stage, drop-in trigger assembly for this platform and provides a construction which is compliant with the European Standard, as that standard is described herein.

Receiver 20 is constructed and arranged in a manner which is generally consistent with and M4/M16 (AR) platform, modified if or as necessary to accommodate trigger assembly 22 and to enable the use of trigger assembly 22 in the intended manner. Included as a part of receiver 20 is a safety selector 24 which is constructed and arranged in the typical manner so as to have a "SAFE" position (see FIG. 2) and a "FIRE" position (see FIG. 3). Included as part of receiver 20 is a hammer 26. Since hammer 26 is specifically constructed and arranged to cooperate with the component parts of trigger assembly 22, it is appropriate to consider hammer 26 as either a separate component assembled into receiver 20 or a component which is arguably a part of trigger assembly 22 given its cooperative relationship with the other trigger assembly component parts.

Figure 2:
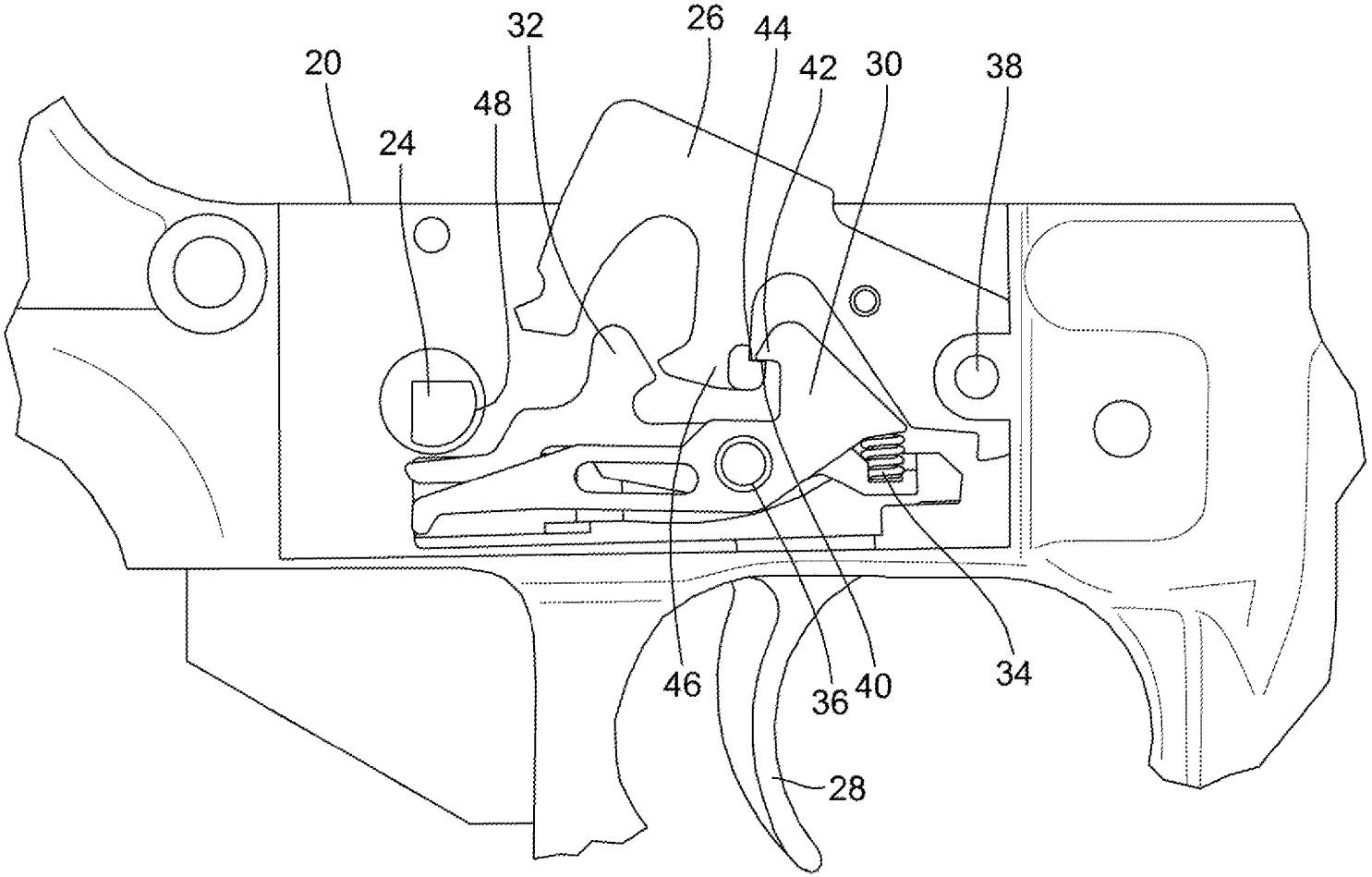
FIG. 2 is a side elevational view of the FIG. 1 trigger assembly in a "SAFE" position with the hammer cocked.

With continued reference to FIGS. 1 and 2, trigger assembly 22 includes a trigger 28, front hook 30, rear hook 32, spring 34 and pivot bushing 36. As noted, the hammer 26 can either be considered a part of trigger assembly 22 or can be considered as a separate component received within receiver 20 similar to the manner that safety selector 24 is received in receiver 20. As noted above, the rear hook 32 may also be referred to as a (the) disconnector. In the illustrated embodiment, hammer 26 is usable with a standard M4/M16 trigger. These trigger assembly 22 components are cooperatively arranged and positioned into the "SAFE" position or condition with the hammer cocked. This is the typical "SAFE" condition for the firearm. Also included in the construction which is illustrated in FIGS. 1 and 2 is a hammer pivot bushing 38 and a cooperating hammer spring (not shown). The geometric center of the hammer pivot bushing 38 represents the pivot axis line for the hammer 26.

As would be understood from the shapes, dimensions, positioning and assembly of the component parts of trigger assembly 22, see FIGS. 1 and 2, the hammer 26 is cocked and captured by front hook 30. More particularly, the sear surface 40 of hook appendage 42 lays over the sear surface 44 of hammer appendage 46. Pulling on the trigger 28 imparts a rotational force vector to the front hook 30 and to the rear hook 32 for their rotation about the pivot axis of pivot bushing 36. With the safety selector 24 and the "SAFE" position as illustrated in FIGS. 1 and 2, rotation of the front hook 30 and of the rear hook 32 about the pivot bushing 36 is prevented by the physical abutment of the front hook 30 and of the rear hook 32 against abutment surface 48 of the safety selector 24.

With continued reference to FIGS. 1 and 2, it is to be understood that the pivot bushing 36 extends through both the front hook 30 and the rear hook 32 in a direction which is into the plane of the paper and laterally to the plane of receiver 20. This construction allows these two hook components and the trigger to rotate somewhat independently of each other. The pivot bushing 36 also extends through a portion of the trigger 28. The use and positioning of spring 34 ties these two hook components together such that clockwise rotation of the front hook 30 about the pivot axis of pivot bushing 36 affects the movement (rotation in a clockwise (CW) direction) of the rear hook 32. A portion of trigger 28 is engaged with a portion of the front hook 30 such that pulling back on the trigger 28 imparts a rotational force vector, about the pivot axis of pivot bushing 36, against the front hook 30 tending to rotate the front hook 30 in a CW direction. The portions of the trigger 28 and front hook 30 which are in engagement as a result of trigger pull are to the left of the pivot bushing 36. The spring 34 is to the right of and forward of the pivot bushing 36. In view of the orientation of the receiver 20 and trigger assembly 22, the left direction is proximal to the user of the firearm while the right direction is distal to the user of the firearm. The rear hook 32 and hammer 26 are not in direct contact with each other in the firearm condition illustrated in FIGS. 1 and 2.

Figure 3:
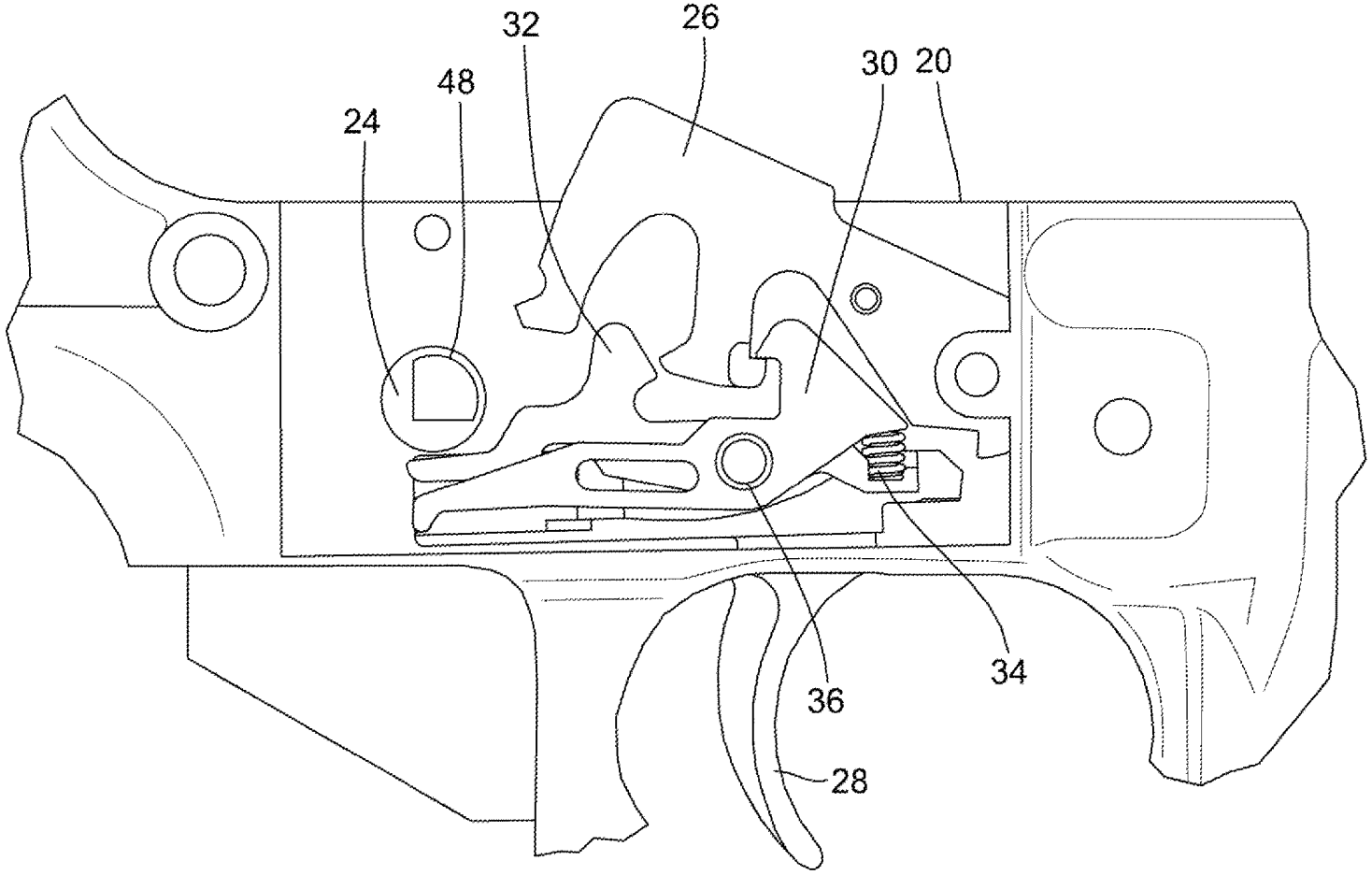
FIG. 3 is a side elevational view of the FIG. 2 trigger assembly with the safety selector in the "FIRE" position.

With reference to the firearm condition which is illustrated in FIG. 3, the safety selector 24 has been placed in the "FIRE" position. The abutment surface 48 of the safety selector 24 which prevented rotation of the trigger and release of the hammer 26 has been moved to a second position which provides clearance for the trigger to rotate to release the hammer to be released. In the firearm condition of FIG. 3 the firearm is ready to fire when the trigger 28 is pulled.

The trigger 28 rotates about the axis of the pivot bushing 36 and this in turn causes the front hook 30 to rotate in a CW direction about the axis of the pivot bushing 36. As the right side of the front hook 30 acts on spring 34, the rear hook 32 rotates in a CW direction about the axis of pivot bushing 36. With the abutment surface 48 moved out of the way, the safety selector 24 does not inhibit or prevent this described rotation of the trigger 28, the front hook 30 and the rear hook 32.

Figure 4:
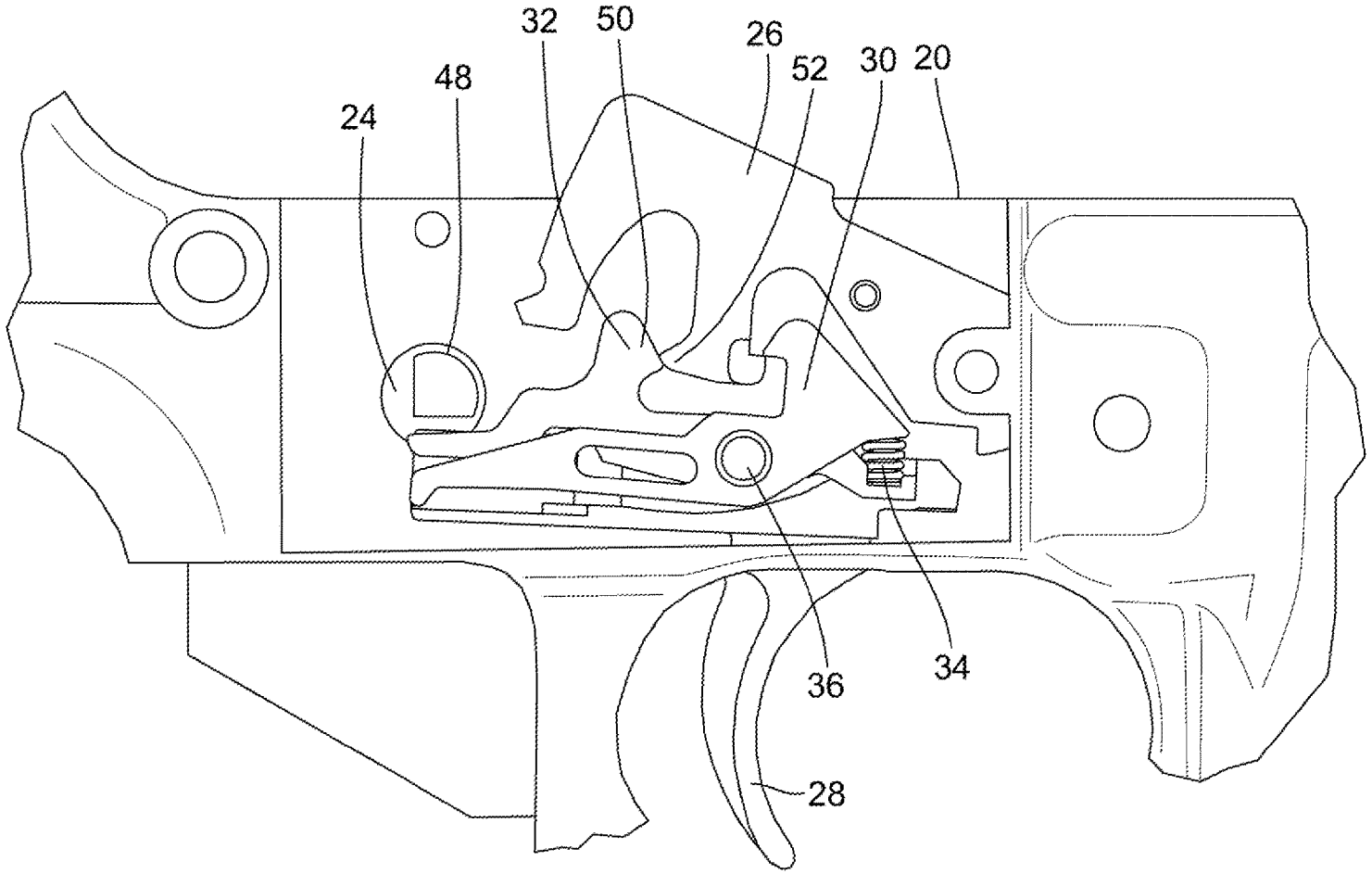
FIG. 4 is a side elevational view of the FIG. 2 trigger assembly in a position which denotes the end of the first stage of trigger pull.

With reference to FIG. 4, the end of the first stage trigger pull is illustrated. Transitioning from the FIG. 3 firearm condition to the FIG. 4 firearm condition it will be seen that appendage 50 of the rear hook 32 is rotated into contact with an abutment surface 52 of the hammer 26. In a two-stage trigger assembly the first stage has a relatively long travel which stops when the appendage 50 of the rear hook 32 contacts the mating or abutment surface 52 of the hammer 26.

Further rotation of the trigger 28 (trigger pull) results in the rear hook 32 remaining in the illustrated position (i.e. generally stationary) against the hammer 26 while other components of the trigger assembly, notably the trigger 28 and the front hook 30, continue to rotate in a CW direction about the axis of pivot bushing 36.

During the second stage of a two-stage trigger assembly, the spring 34 is compressed by the continued CW rotation of the front hook 30 and the generally stationary condition of the rear hook 32 due to its abutment against (i.e. engagement with) abutment surface 52 of the hammer 26. As the spring 34 is compressed, the reacting force creates an increased force against trigger pull due to needing to compress spring 34 to move front hook 30 with rear hook 32 resisting that movement thereby requiring a greater force to pull or rotate the trigger 28. As a result, the second stage of movement of trigger assembly 22 requires a higher pull force, but only for a relatively short travel distance. The safety selector 24 does not inhibit or prevent the trigger assembly 22 from progressing through both of these described stages when in the "FIRE" position (setting).

With continued reference to FIG. 4 it will be understood that as the spring 34 is compressed, the CW rotation of the front hook 30 continues and the sear surface 40 is rotated away from or off of sear surface 44. This disengagement of sear surfaces results in release of the hammer 26 and the firing of the firearm. At this stage in the firing sequence the only component preventing release of the hammer is the front hook 30. Once the front hook 30 pivots out of engagement with the hammer 26, at the sear surfaces, the hammer 26 is released for firing.

Figure 5:
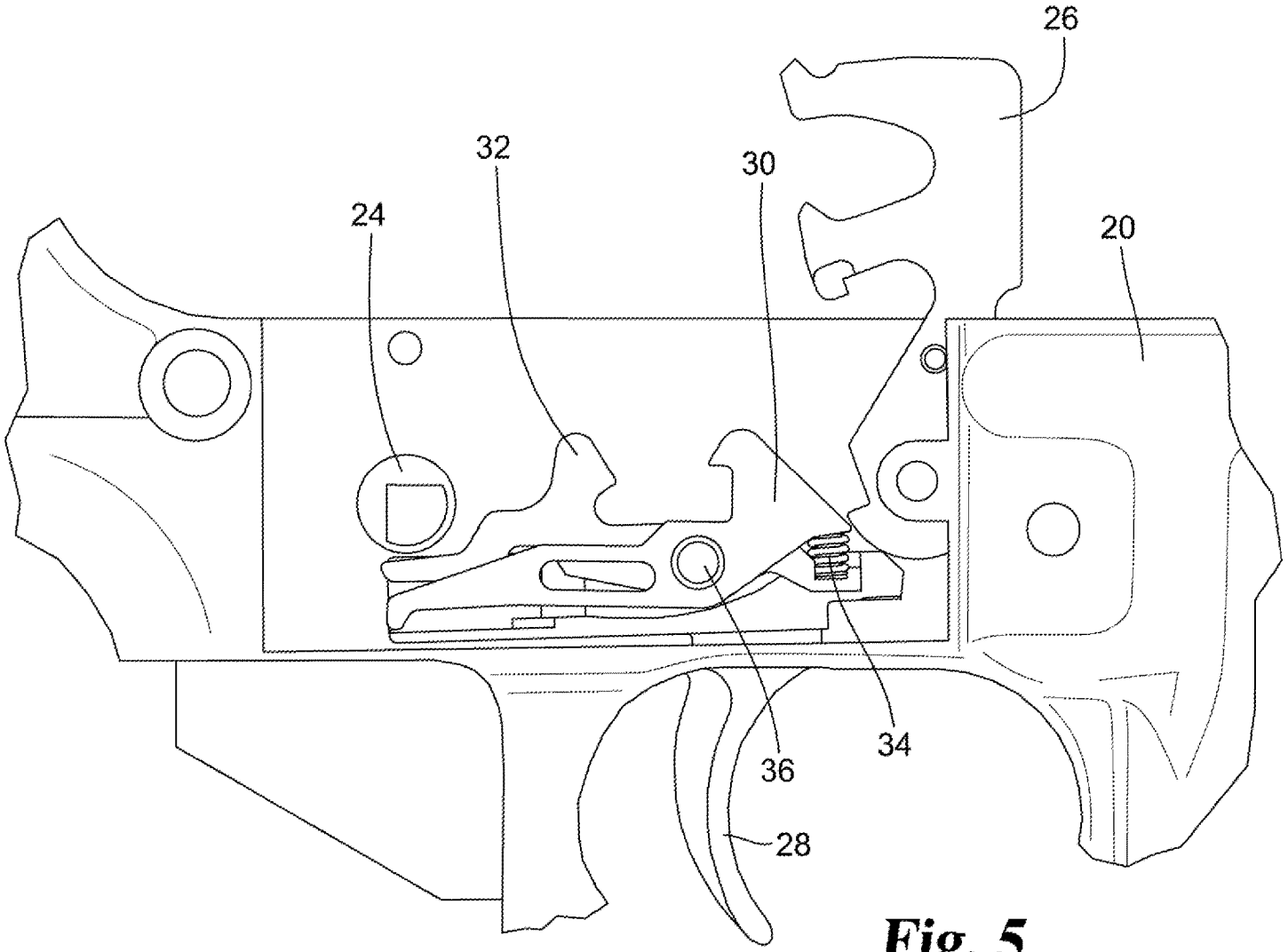
FIG. 5 is a side elevational view of the FIG. 2 trigger assembly in a European Standard compliant position allowing a "SAFE" position setting with the hammer in the up/forward position.

With reference to FIG. 5 it will be noted that any one of several potential malfunctions can occur which would result in a "failure to fire" condition which leaves the hammer in the up/forward position. This "failure to fire" condition is illustrated in FIG. 5. According to what is been explained herein as being the "European Standard", and in order for trigger assembly 22 to be compliant with that Standard, the following steps must be permitted by the construction and arrangement of the trigger assembly, in this case trigger assembly 22, as used for the M4/M16 (AR) platform.

First, with the hammer 26 in the illustrated up/forward position (see FIG. 5), the user of the firearm (i.e. the shooter) is required to take the force off the trigger 28. The next step is to rotate the safety selector 24 to the "SAFE" position as is illustrated in FIG. 5. As a reminder, the construction and arrangement of a standard or conventional M4/M16 (AR) trigger does not allow the trigger to return to a position where the safety selector can be rotated to the "SAFE" position when the hammer is up/forward.

Compliance with the European Standard by trigger assembly 22 is enabled in part by a change in the design of the front hook 30. This change in design of its shape and dimensions allows the front hook to rotate just enough to allow the hammer 26 to move front hook 30 out of the way to allow recocking of the hammer 26 when the trigger 28 rotation would otherwise be impaired or blocked by having the safety selector 24 in the "SAFE" position. A further feature of trigger assembly 22 relates to the design of trigger 28. Trigger 28 has been designed so as to not require the trigger 28 to be depressed when the hammer 26 is in the up/forward position (see FIG. 5). The trigger position/condition allows the safety selector 24 to be engaged and the hammer 26 to be recocked with the safety selector 24 in the "SAFE" position. This thus satisfies the European Standard.

A related design feature of the disclosed embodiment is to relocate the spring 34 to a position to the right of (i.e. ahead of) the trigger pivot (i.e. the axis of pivot bushing 36) and to allow the front hook 30 to pivot up to approximately 8.5 degrees. This permitted rotation of the front hook 30 would only be enabled when the hammer 26 must move by the front hook 30 when the trigger 28 is prevented from rotating due to the safety selector 24 being placed in the "SAFE" position. At all other times the front hook 30 remains stationary with or to the trigger 28.

Disconnector spring 34 positioned under the front hook 30, as illustrated in the drawings, applies sufficient force to the front hook 30 to lessen any potential movement due to shock loading. Shock loading would typically occur during drop-testing of the corresponding firearm. Further, by having the front hook 30 pivot about the trigger pivot axis, i.e. the axis of pivot bushing 36, the design and construction of trigger assembly 22 keeps the center of mass of the front hook 30 relatively close to its axis of rotation. This construction helps to minimize or lessen any adverse effects of shock loading. One such adverse effect could be the front hook 30 losing contact with the sear surface 44 of hammer 26.

A further design feature of trigger assembly 22 pertains to the overall design concept for the component parts. Ideally these component parts would be relatively insensitive to manufacturing tolerances. This has been accomplished, at least in part, by shaping and dimensioning the front hook 30 such that the front hook surface which contacts the trigger 28, and thus controls the relative position of the front hook 30 to the trigger 28, be at a distance from the front hook pivot (pivot bushing 36) which lessens the effect of manufacturing tolerances. In the exemplary construction of trigger assembly 22, this distance of the contact point to the front hook pivot is approximately 1.16 inches (2.95 cm). The radius from the front hook pivot of pivot bushing 36 to sear surface 40 is approximately 0.38 inches (9.65 mm). As a result, and as one example, a manufacturing tolerance of +/−0.006 inches (0.152 mm) at the contact point only moves the sear surface 40 approximately +/−0.002 inches (0.05 mm). Maintaining the front hook 30 position relative to trigger 28 enables the use of standard manufacturing tolerances with only minimal effect on the front hook position relative to other fire control components.

Figure 6:
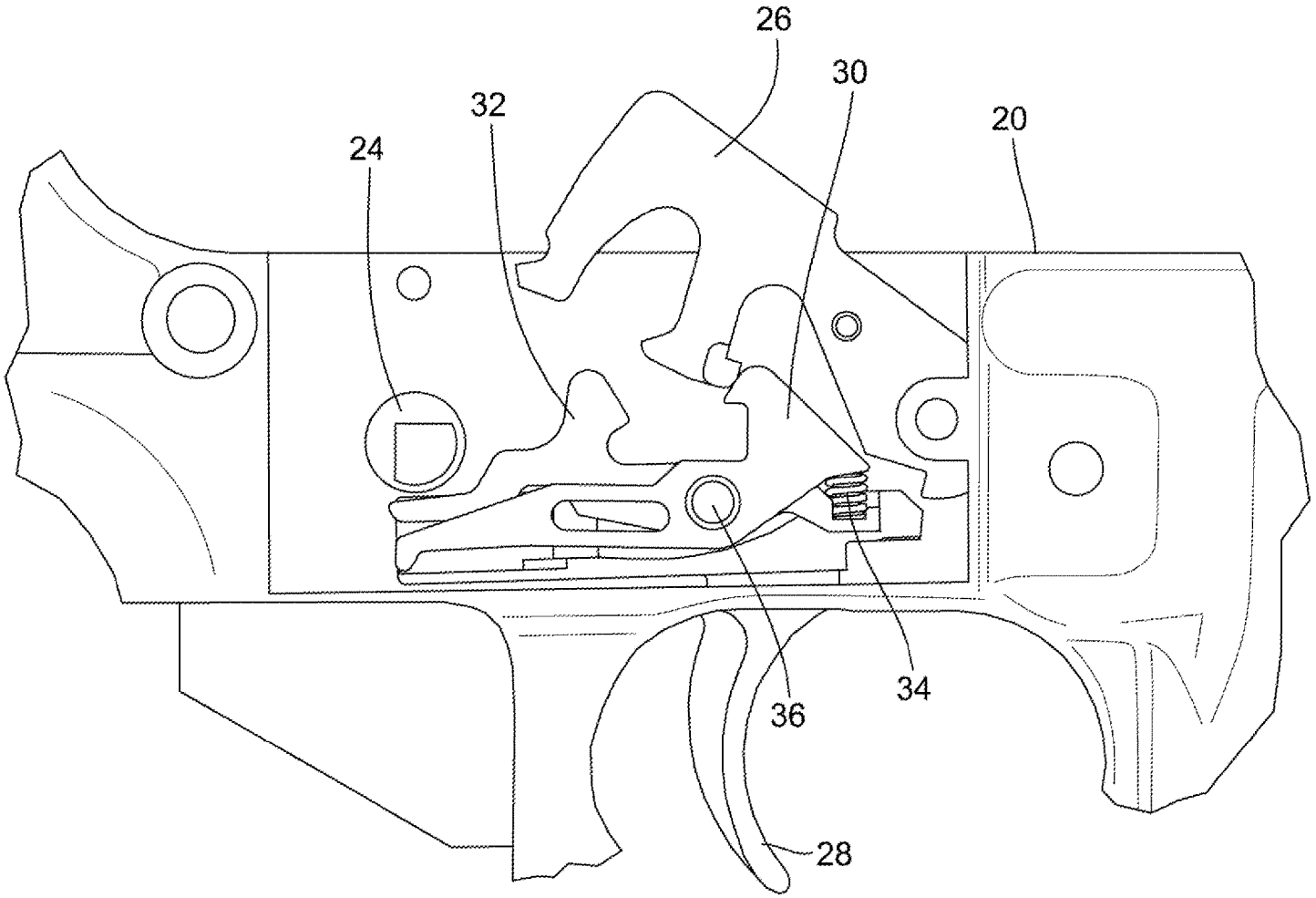
FIG. 6 is a side elevational view of the FIG. 2 trigger assembly illustrating an ability for the hammer to rotate thereby contacting the front hook and causing it to rotate.

With reference to FIG. 6, what is illustrated is the next stage following the FIG. 5 condition as the firearm is being returned to the starting condition of FIGS. 1 and 2. The sequence of steps and component part movement is as follows. First, the trigger 28 is prevented from rotating by having the safety selector 24 in the "SAFE" position. When the user of the firearm draws the bolt carrier to the rear, this causes the hammer 26 to rotate. As illustrated in FIG. 6, as hammer 26 rotates it contacts the front hook 30. This action causes the front hook 30 to rotate in a CW direction about the axis of the pivot bushing 36 relative to trigger 28. The described movement of front hook 30 is enabled by compression of spring 34. Once the hammer 26 passes or is clear of the front hook 30, the front hook 30 returns to its rear position where it once again is positioned to prevent the hammer 26 from rotating. This restores the trigger assembly 22 to the "SAFE" firearm condition illustrated in FIGS. 1 and 2.

Various aspects of the present disclosure are set out in the following numbered clauses.

1. A trigger assembly for a firearm which includes a receiver, a safety selector and a hammer, the trigger assembly comprising:

a trigger having a pivot axis;

a front hook constructed and arranged to move with trigger rotation;

a rear hook cooperatively arranged with the front hook;

a spring positioned between the front hook and the rear hook; and wherein the front hook and the trigger are constructed and arranged relative to the safety selector and to the hammer to allow the hammer to be re-cocked from an upright position with the safety selector in a "SAFE" position.

2. The trigger assembly of clause 1 wherein the front hook includes a sear surface and the hammer includes a sear surface wherein the engagement of the sear surfaces with each other maintains the hammer in a cocked condition.

3. The trigger assembly of any of the preceding clauses which further includes a pivot bushing which defines the pivot axis of the trigger.

4. The trigger assembly of clause 3 wherein the pivot bushing extends through the trigger, the front hook and the rear hook.

5. The trigger assembly of any of the preceding clauses wherein the safety selector is proximal to the pivot axis and the spring is distal to the pivot axis.

6. The trigger assembly of any of the preceding clauses wherein the front hook has a pivot axis which coincides with the pivot axis of the trigger.

7. The trigger assembly of any of the preceding clauses wherein the rear hook has a pivot axis which coincides with the pivot axis of the trigger.

8. The trigger assembly of any of the preceding clauses wherein the trigger includes a portion which engages a cooperating portion of the front hook.

9. The trigger assembly of clause 8 wherein the cooperating portion of the front hook defines a contact location with the trigger which is approximately 1.16 inches (2.95 cm) from the pivot axis of the front hook.

10. Trigger assembly of any of the preceding clauses wherein the front hook has a pivot axis and a sear surface which is positioned approximately 0.38 inches (9.65 cm) from the pivot axis.

11. The trigger assembly of any of the preceding clauses wherein the trigger assembly is constructed and arranged as a two-stage, drop-in trigger assembly which is compliant with the European Standard for an M4/M16 (AR) platform.

12. A two-stage, drop-in trigger assembly for a firearm which includes a receiver, a safety selector and a hammer, the trigger assembly comprising: a trigger and a cooperating front hook which are constructed and arranged to enable the hammer to be recocked from an up/forward position with the safety selector in the "SAFE" position.

13. The trigger assembly of clause 12 which further includes a rear hook and a spring which is positioned between the front hook and the rear hook.

14. The trigger assembly of clause 12 or clause 13 wherein the front hook includes a sear surface and the hammer includes a sear surface wherein the engagement of the sear surfaces with each other maintains the hammer in a cocked condition.

15. The trigger assembly of clause 12 or clause 13 or clause 14 which further includes a pivot bushing which defines the pivot axis of the trigger.

16. The trigger assembly of clause 15 wherein the safety selector is proximal to the pivot bushing and the spring is distal to the pivot bushing.

17. A two-stage, drop-in trigger assembly for a firearm which is compliant with the European Standard wherein a front hook component is constructed and arranged to allow it to rotate just enough to allow the hammer to move the front hook out of the way to allow re-cocking of the hammer when the trigger rotation is impaired by having the safety selector in the "SAFE" position.

18. A two-stage, drop-in trigger assembly for a firearm which is compliant with the European Standard wherein the trigger is constructed and arranged such that it does not need to be depressed when the hammer is in the up/forward position and wherein the trigger allows for both the safety selector to be engaged and for the hammer to be re-cocked with the safety selector in the "SAFE" position.

19. A two-stage, drop-in trigger assembly for a firearm which is compliant with the European Standard wherein a front hook defines a surface location which contacts a portion of the trigger and wherein the distance from the surface location to the pivot axis of the front hook is approximately 1.16 inches (2.95 cm).

20. A two-stage, drop-in trigger assembly for a firearm which is compliant with the European Standard wherein a front hook spring is positioned ahead of the trigger pivot axis and the components of the trigger assembly enable the front hook to pivot up to 8.5 degrees when the hammer must move by the front hook when the trigger is prevented from rotating due to safety selector being set to the "SAFE" position.

Figure 7A:
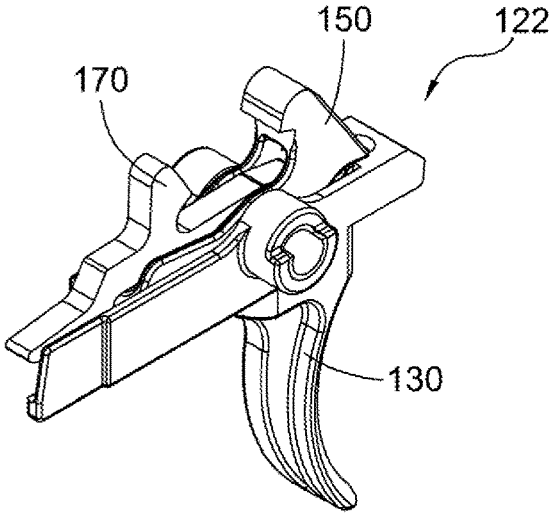
FIGS. 7A-7C illustrated several views of an alternative embodiment of a trigger assembly.
Figure 7C:
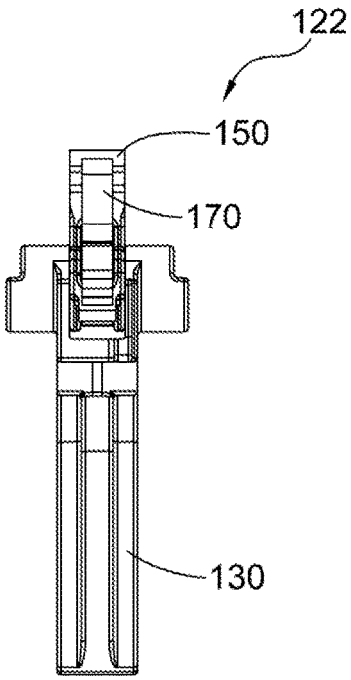
Figure 7B:
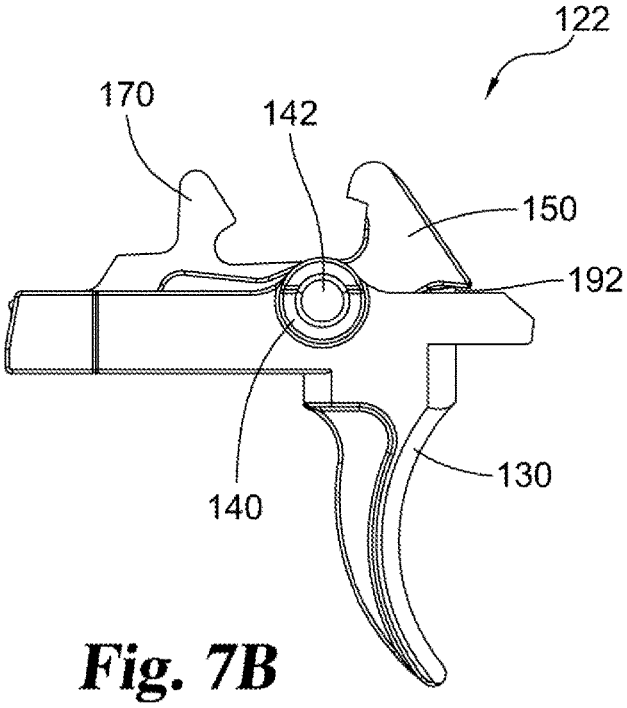

Referring to FIGS. 7A-7C, trigger assembly 122 is illustrated. Trigger assembly 122 generally includes trigger 130, bushing 140, pin 142, front hook 150, rear hook 170 and spring 192.

Figure 8:
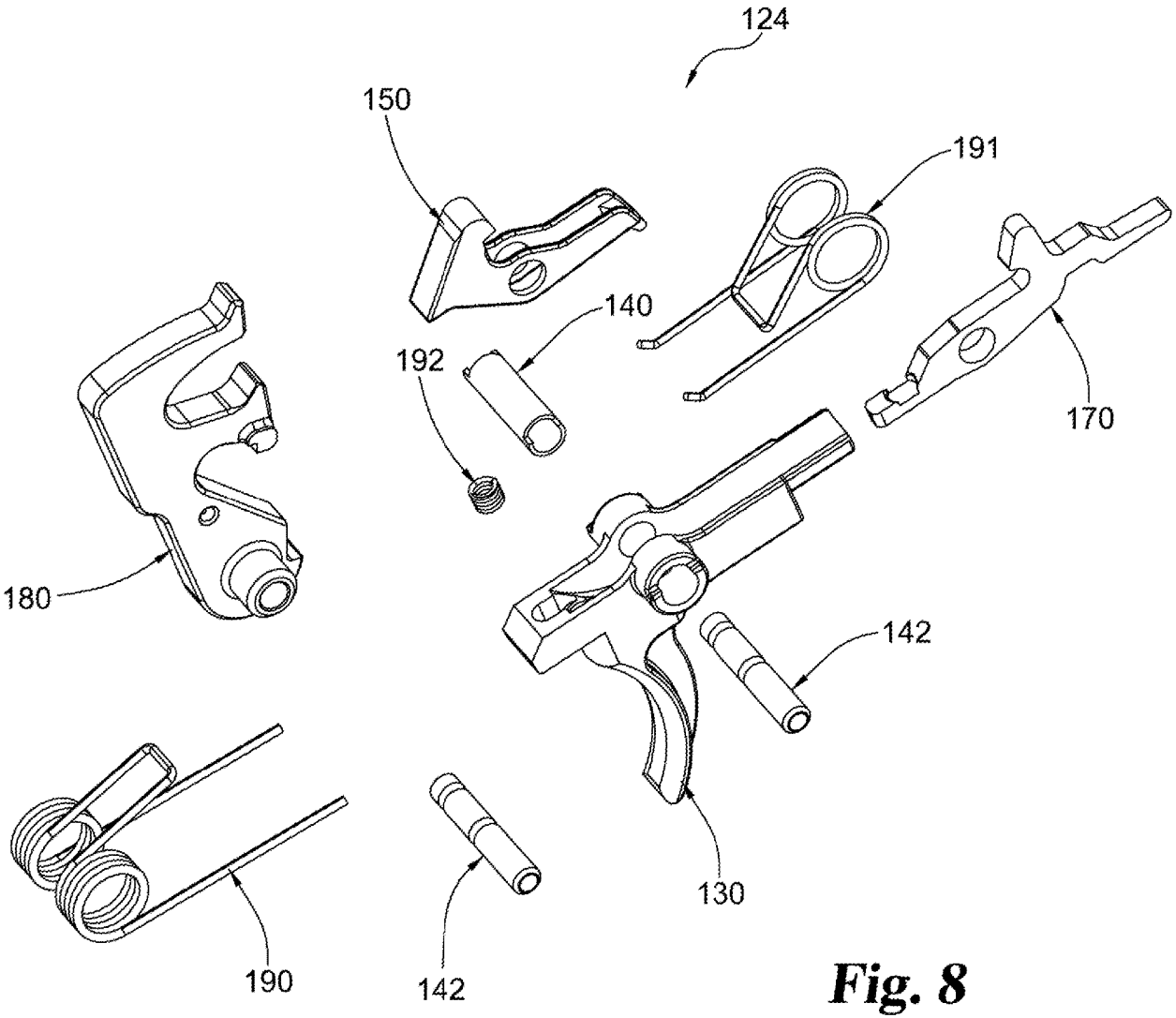
FIG. 8 is an assembly view of an alternative embodiment of a hammer and trigger group.
Figure 9A:
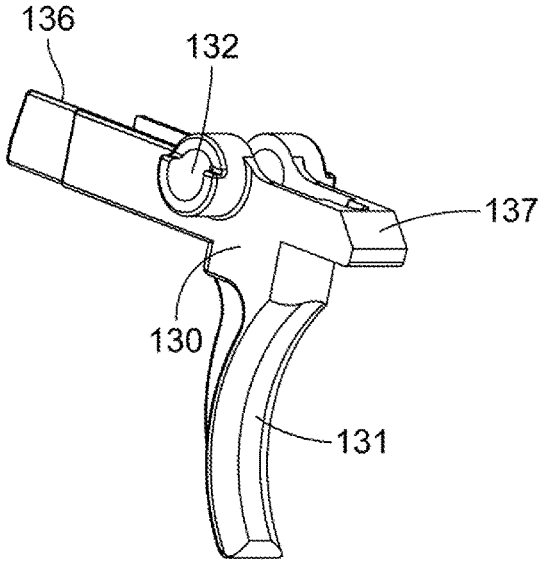
FIGS. 9A-9D illustrates several views of a trigger, a component of the FIGS. 7A-7C trigger assembly.
Figure 9C:
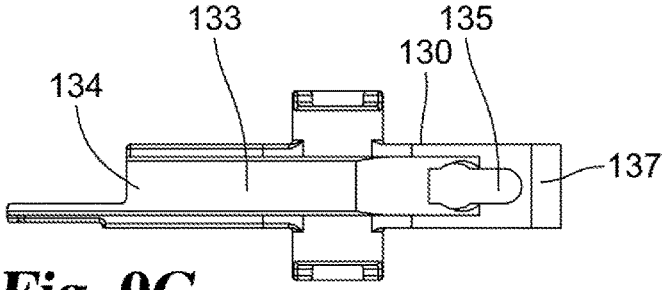
Figure 9D:
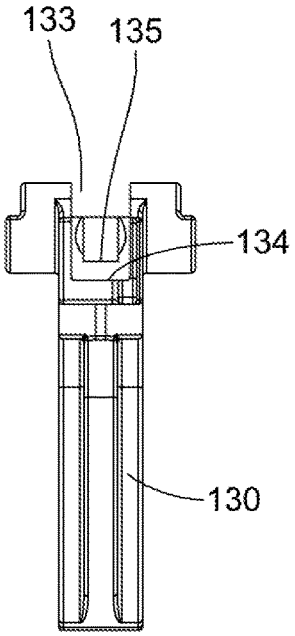
Figure 9B:
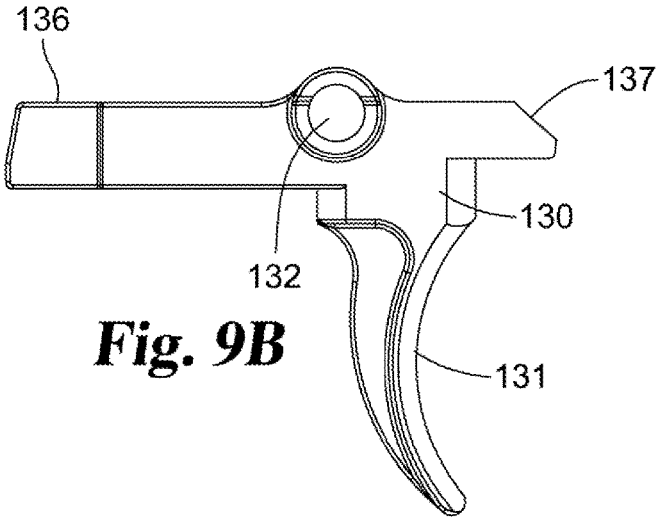
Figure 10A:
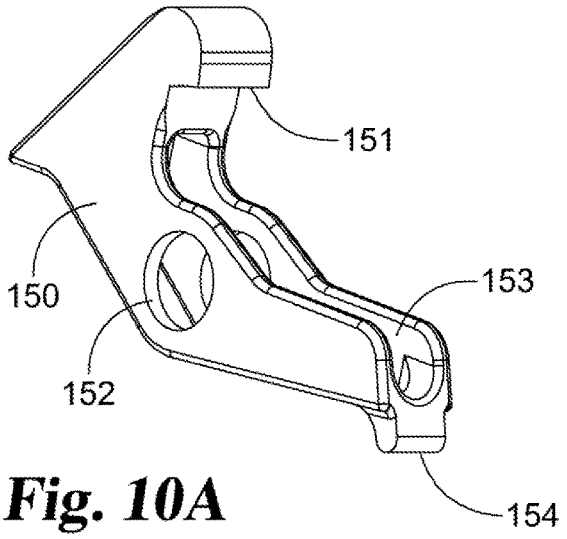
FIGS. 10A-10D illustrates several views a front hook, a component of the FIGS. 7A-7C trigger assembly.
Figure 10B:
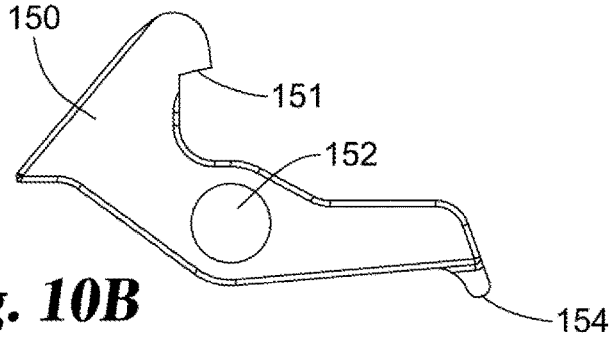
Figure 10D:
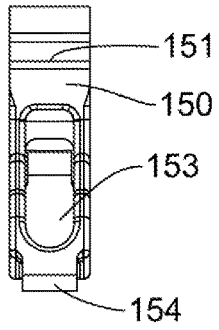
Figure 10C:
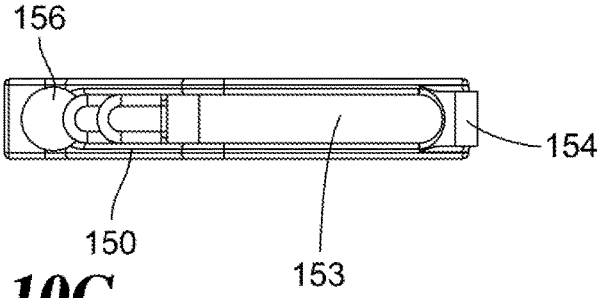
Figure 11A:
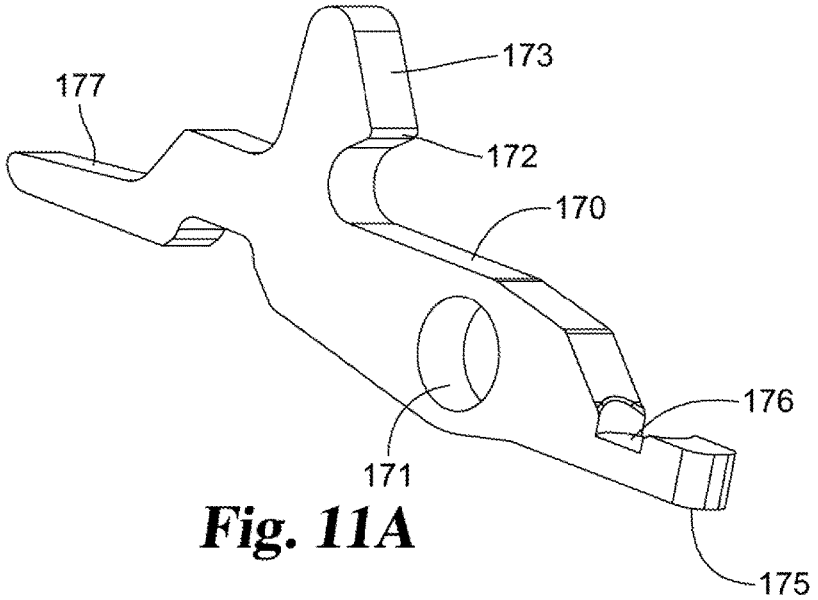
FIGS. 11A-11D illustrates several views a rear hook, a component of the FIGS. 7A-7C trigger assembly.
Figure 11B:
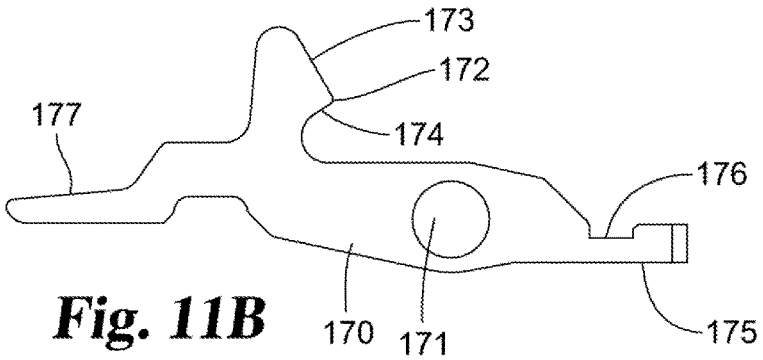
Figure 11D:
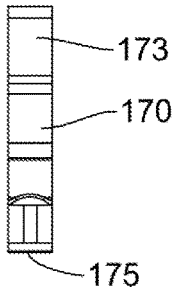
Figure 11C:
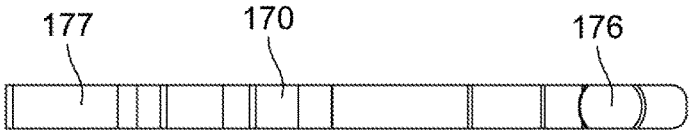

Referring to FIG. 8, trigger and hammer group 124 is illustrated. Trigger and hammer group 124 generally includes trigger 130, bushing 140, pins 142, front hook 150, rear hook 170, spring 190, spring 191 and spring 192.

Referring to FIGS. 9A-9D, trigger 130 is illustrated. Trigger 130 generally includes pulling surface 131, pivot point 132, trough 133, seat 134, seat 135, surface 136 and relief 137.

Referring to FIGS. 10A-10D, front hook 150 is illustrated. Front hook 150 generally includes sear 151, pivot 152, slot 153, seat 154 and seat 156. Similar to front hook 30 described above, in one embodiment, seat 154 is approximately 1.16 inches (29.5 cm) from pivot 152 and sear 151 is approximately 0.38 inches (9.65 cm) from pivot 152.

Referring to FIGS. 11A-11D, rear hook 170 is illustrated. Rear hook 170 generally includes pivot 171, projection 172, surface 173, surface 174, seat 175, seat 176 and surface 177.

Figure 12B:
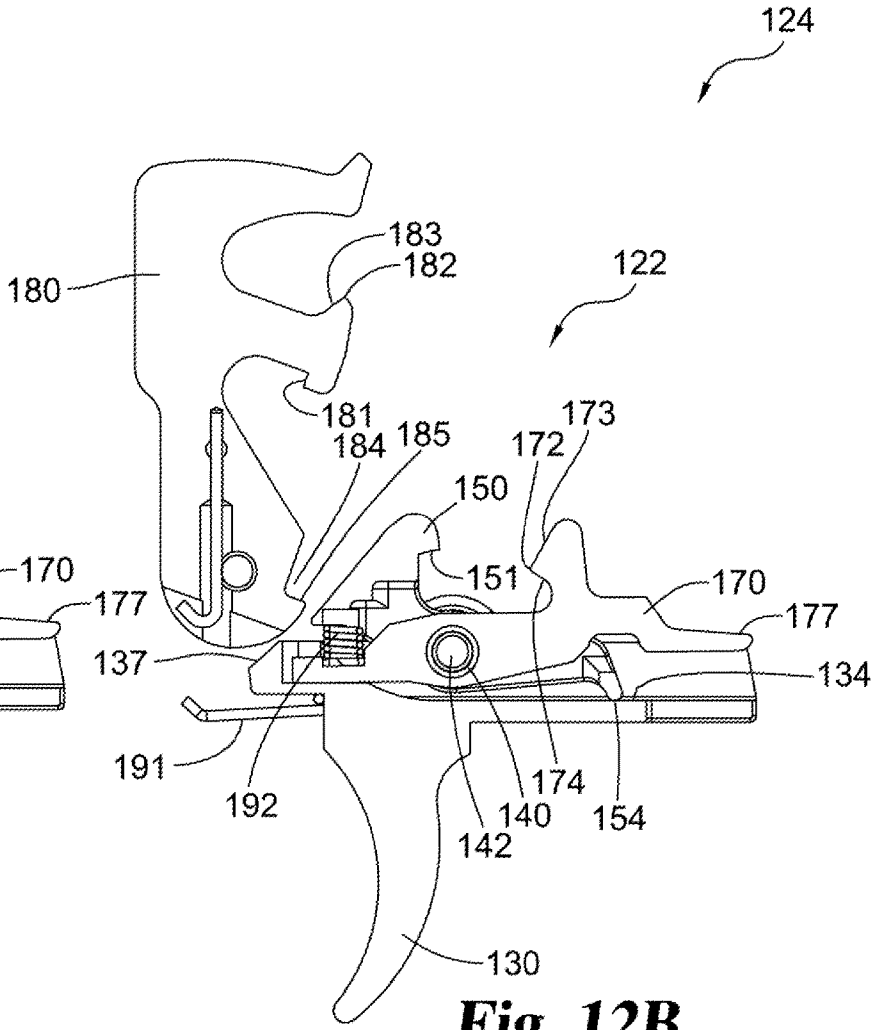
FIG. 12B illustrates a cross sectional view of the FIG. 12A hammer and trigger group.
Figure 12A:
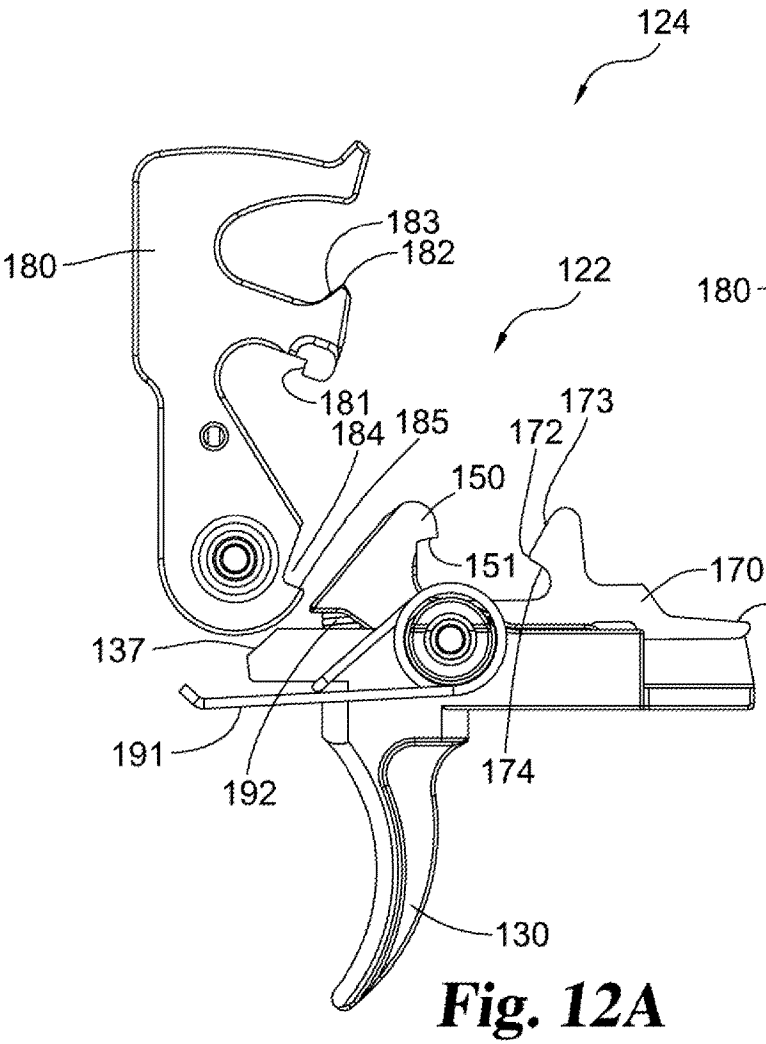
FIG. 12A illustrates a side view of the FIG. 8 hammer and trigger group.

Referring to FIGS. 12A and 12B, trigger and hammer group 124 is illustrated. Specifically, trigger and hammer group 124 is illustrated with trigger assembly 122 positioned in a neutral position (where the safety selector can be engaged) with hammer 180 positioned in an un-cocked position. Trigger 130 is biased in a counter-clockwise direction by spring 191. Relief 137 provides sufficient clearance that no part of hammer 180 abuts trigger 130. As discussed above, this facilitates compliance with the European Standard.

As best seen in FIGS. 12A and 12B, pin 142 and bushing 140 rotationally couple trigger 130, front hook 150 and disconnector 170 together. Front hook 150 and disconnector 170 are biased apart by spring 192. Disconnector 170 passes through slot 153 and disconnector and front hook 150 pass through trough 133. In the illustrated neutral position, seats 135 and 175 abut, seats 134 and 154 about and spring 192 is compressed between seats 156 and 176 forward of pin 142. Surface 177 and/or 136 are positioned to abut abutment surface 48 of the safety selector 24 in the "SAFE" position. Trigger assembly 122 operates similarly to trigger assembly 22 described above.

Hammer 180 is biased in a counter-clockwise direction by spring 190. Hammer 180 includes sear 185 and relief 184 proximate to sear 185. Sear 185 is operable with a conventional M16 trigger to hold hammer 180 in a cocked position. However, in the disclosed configuration, there is no complementary sear on trigger 130 as relief 137 removes such a sear. With the inclusion of sear 185, hammer 180 is operable with other trigger mechanisms such as a conventional M16 trigger.

As described above, sear surfaces 151 and 181 interlock when hammer 180 is in a cocked position. Pulling trigger 130 rotates trigger assembly 122 in a counter-clockwise direction against the biasing force of spring 191 until edge 182 abuts surface 173. At this point rear hook 170 resists further rotation in the counter-clockwise direction. Applicant of additional force to the trigger causes spring 192 to compress and increases a gap between front hook 150 and rear hook 170 until sear surfaces 151 and 181 release, at which point hammer 180 is rotated counter-clockwise under the basing force of spring 190.

The impact of hammer 180 on a firing pin (not illustrated) fires a bullet. As a result, a bolt carrier group (not illustrated) cycles to reload another round. The cycling bolt carrier group also pushes hammer 180 in a clockwise direction to be re-cocked. Edge 182 on clockwise moving hammer 180 first impacts surface 173 on rear hook 170, rotating rear hook 170 clockwise until edge 182 clears projection 172 at which point rear hook 170 rotates clockwise so that surface 174 captures surface 183. Once pressure is removed from trigger 130 so that it rotates clockwise back to the illustrated position, retention of hammer 180 transfers from surface 174 and surface 183 to sear surfaces 151 and 181.

During testing of trigger and hammer group 124, an unexpected improvement was identified. In many triggers, if the operator holds the trigger in a depressed position through the reload cycle, the operator can experience a forward counter force applied to the pull surface of the trigger due to the hammer impacting the rear hook, which often would compress the spring between the trigger and the rear hook to the spring's stack height causing some portion of the impact to be transmitted through the trigger to the operator's finger depressing the trigger. This has been referred to as "trigger slap." Conversely, holding the trigger of trigger and hammer group 124 in the depressed position during the reload cycle resulted in a significant reduction and even elimination of felt trigger slap. The illustrated configuration of the front hook and rear hook results in the hammer generating insignificant trigger slap during re-cocking of the hammer. For individuals who frequently shoot weapons with triggers that produce trigger slap, trigger slap can result in problems such as tendonitis and/or nerve damage. Eliminating trigger slap may be beneficial for some operators who experience such negative effects.

Figure 13A:
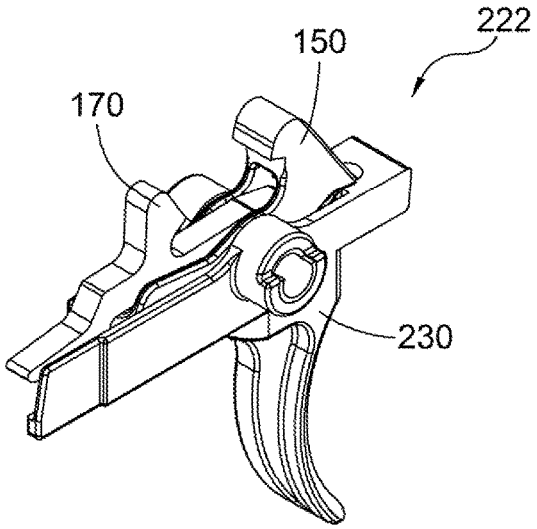
FIGS. 13A-13C illustrated several views of an alternative embodiment of a trigger assembly.
Figure 13C:
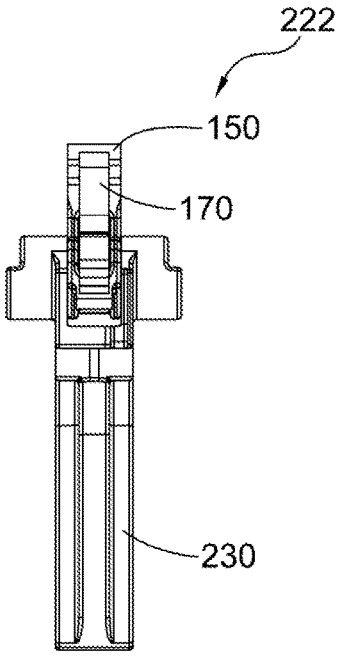
Figure 13B:
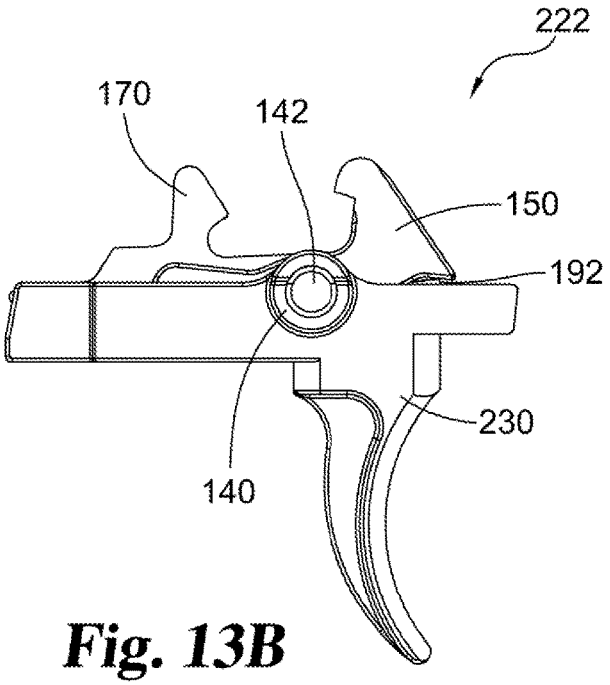
Figure 14A:
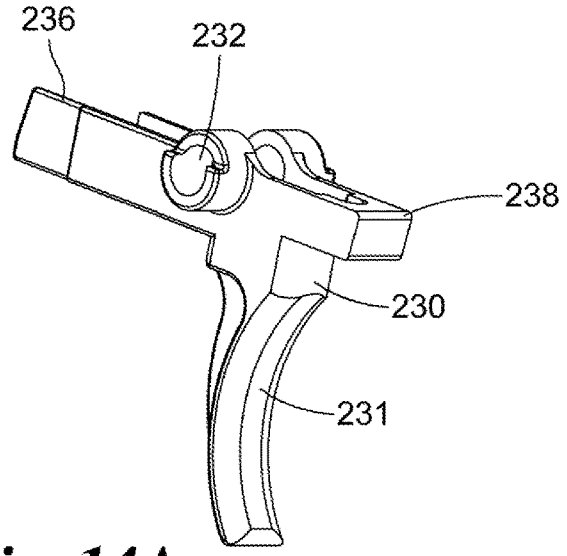
FIGS. 14A-14D illustrates several views of a trigger, a component of the FIGS. 13A-13C trigger assembly.
Figure 14C:
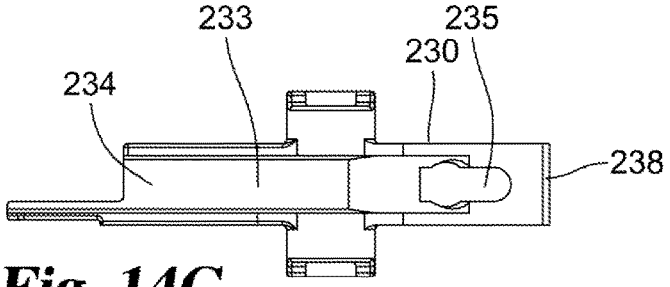
Figure 14D:
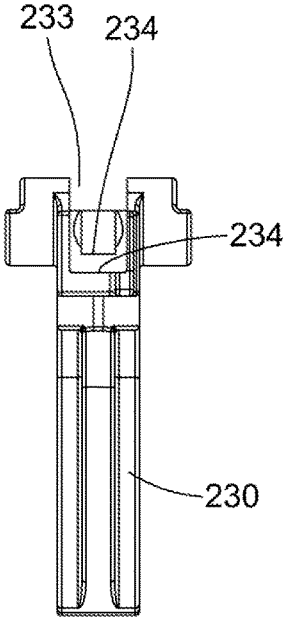
Figure 14B:
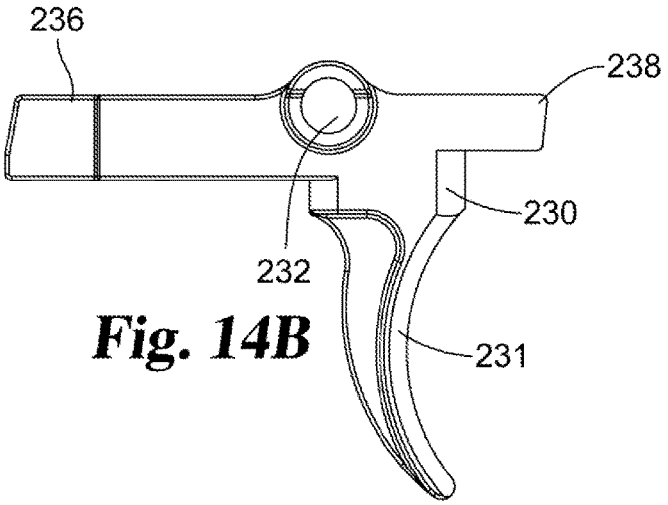

Referring to FIGS. 13A-13C, trigger assembly 222 is illustrated. Trigger assembly 222 generally includes trigger 230, bushing 140, pin 142, front hook 150, rear hook 170 and spring 192.

Referring to FIGS. 14A-14D, trigger 230 is illustrated. Trigger 230 generally includes pulling surface 231, pivot point 232, trough 233, seat 234, seat 235, surface 236 and projection 238.

Figure 15B:
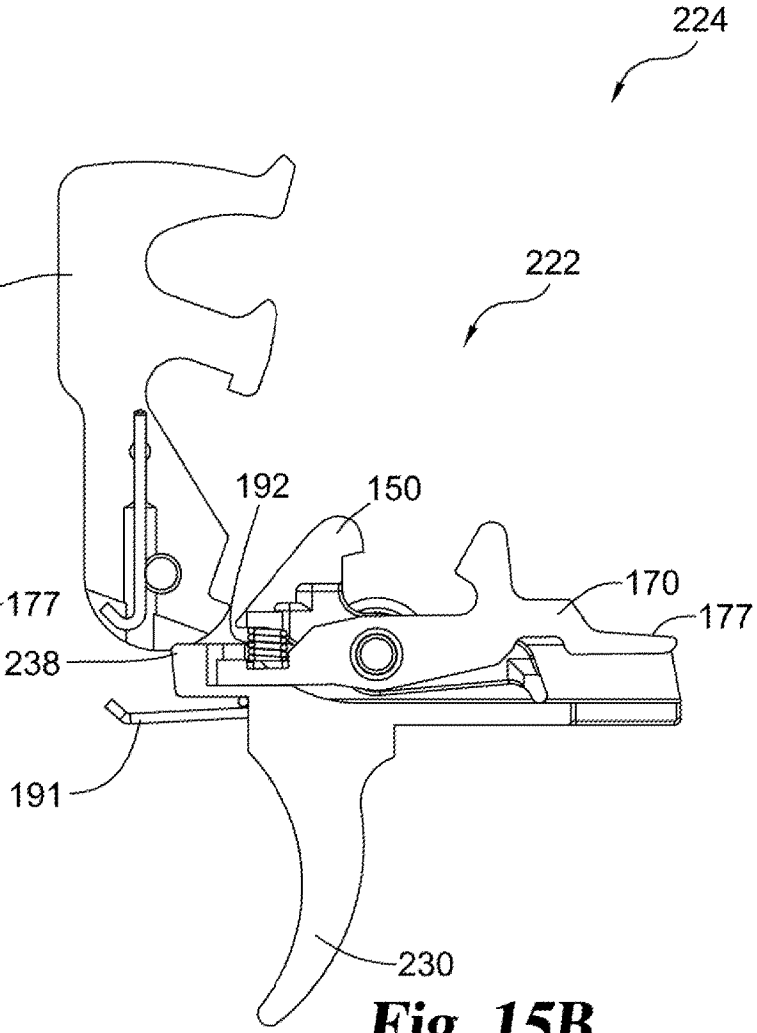
FIG. 15B illustrates a cross sectional view of the FIG. 15A hammer and trigger group.
Figure 15A:
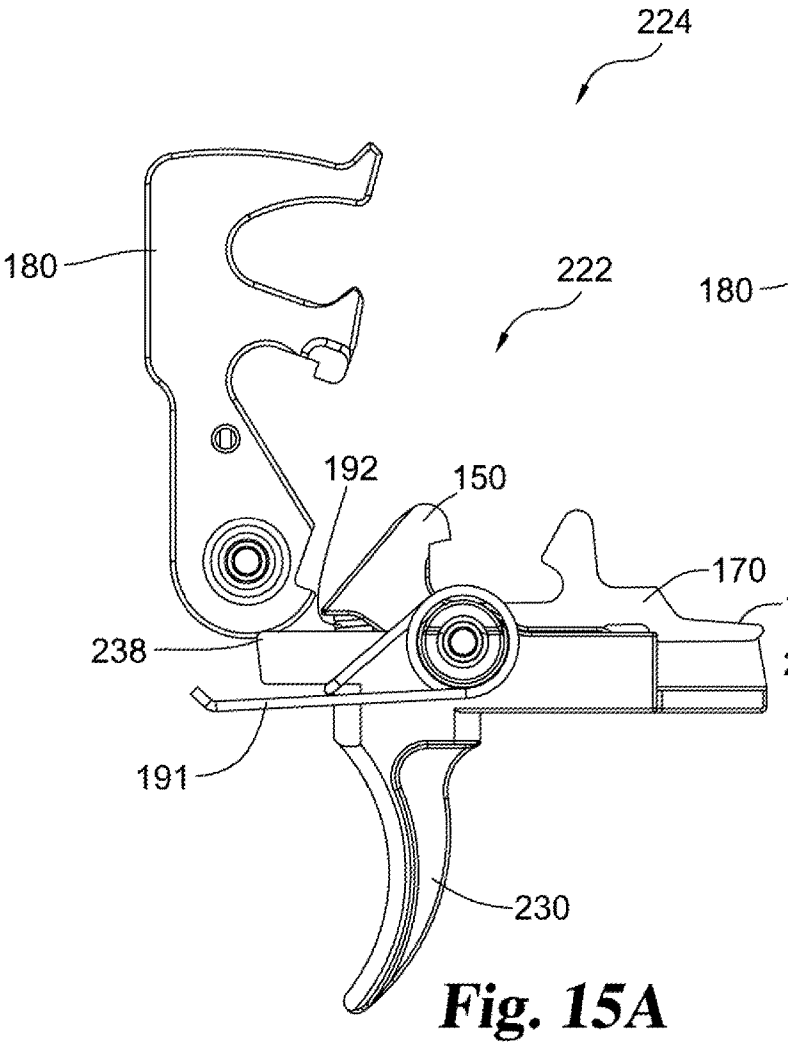
FIG. 15A illustrates a side view of a hammer and trigger group incorporating the FIGS. 13A-13C trigger assembly.

Referring to FIGS. 15A and 15B, trigger and hammer group 224 is illustrated. Specifically, trigger and hammer group 224 is illustrated with trigger assembly 222 positioned in a neutral position (where the safety selector can be engaged) with hammer 180 positioned in an un-cocked position. In this position, projection 238 overlaps hammer 180 indicating that this position is not attainable. If the hammer is in the illustrated un-cocked position, projection 238 would force trigger assembly 222 to rotate counter-clockwise, which would position surface 177 above abutment surface 48 of the safety selector 24, preventing engagement of the safety when hammer 180 is positioned in an un-cocked position. While this does not comply with the European Standard, it does comply with standard operation of United States M4/M16 firearms. Other than having projection 238 instead of relief 137, trigger and hammer group 224 operates the same as trigger and hammer group 124 described above.

While the above triggers have been described in the context of use with M4/M16 type weapons, the disclosed trigger system could be readily modified to work with other types of weapons as well as other calibers of ammunition. For example, the disclosed trigger system could be used in weapons chambers for many different calibers, including, but not limited to, 9 mm, 10 mm, .40 S&W, .45 ACP, .300 AAC Blackout, .308 Winchester, 7.62 mm×51 mm and 50 BMG.

While the present disclosure has been illustrated and described in detail in the drawings and foregoing description, the same is to be considered as illustrative and not restrictive in character, it being understood that a preferred embodiment has been shown and described and that all changes, equivalents, and modifications that come within the spirit of the claimed invention defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The language used in the claims and the written description and in the above definitions is to only have its plain and ordinary meaning, except for terms explicitly defined above. Such plain and ordinary meaning is defined here as inclusive of all consistent dictionary definitions from the most recently published (on the filing date of this document) general purpose Merriam-Webster dictionary.

The invention claimed is:

1. An assembly for a firearm which includes a receiver and a safety selector, the assembly having a forward and rearward direction, the assembly comprising:

a spring loaded hammer that comprises a first hammer sear surface and a hammer edge;

a spring loaded trigger rotatable about a pivot axis, the trigger and comprises a pulling surface for an operator to pull the trigger, wherein the pulling surface faces the forward direction and is pulled in the rearward direction, a first seat forward of the pivot axis and a second seat rearward of the pivot axis;

a front hook rotatable about the pivot axis, wherein the front hook comprises a third seat forward of the pivot axis, a fourth seat rearward of the pivot axis, and a front hook sear surface, wherein the engagement of the front hook and first hammer sear surfaces with each other maintains the hammer in a cocked condition and wherein the fourth seat is adapted to selectively abut the second seat so that the front hook selectively rotates with the trigger;

a rear hook rotatable about the pivot axis, wherein the rear hook comprises a rear hook surface, a fifth seat and a sixth seat, wherein the fifth seat is adapted to selectively abut the first seat so that the rear hook selectively rotates with the trigger and wherein the rear hook surface is adapted to abut the hammer edge to increase the force required to pull the trigger to release the front hook and first hammer sear surfaces; and a spring positioned between the third and sixth seat which biases the front hook and the rear hook apart.

2. The assembly of claim 1, wherein the hammer further comprises a second hammer sear surface and a relief proximate to the second hammer sear surface.

3. The assembly of claim 1, wherein the front hook and the trigger are constructed and arranged relative to the safety selector and to the hammer to allow the hammer to be recocked from an upright position with the safety selector in a "SAFE" position.

4. The assembly of claim 1, wherein the trigger defines a trough that houses a portion of the front hook and a portion of the rear hook.

5. The assembly of claim 4, wherein the front hook defines a slot that the rear hook passes through.

6. The assembly of claim 1, wherein the trigger defines a recess such that the hammer, in an un-cocked position, does not abut the assembly with the safety selector in a "SAFE" position.

7. The assembly of claim 1, wherein the safety selector cannot be placed in a "SAFE" position when the hammer is in an un-cocked position because the trigger abuts the hammer in the un-cocked position.

8. The assembly of claim 1, wherein the assembly is a drop-in two stage trigger for an M4/M16(AR) platform.

9. The assembly of claim 1, wherein third seat is approximately 1.16 inches (29.5 cm) from the pivot axis and wherein the sear surface is approximately 0.38 inches (9.65 cm) from the pivot axis.

10. The assembly claim 1, wherein the front hook, rear hook and spring are constructed and arranged such that the hammer generates insignificant trigger slap during re-cocking of the hammer after firing.

* * * * *